US005279105A

United States Patent [19]

Asai et al.

[11] Patent Number: 5,279,105

[45] Date of Patent: Jan. 18, 1994

[54] ROVING CHIP COLLECTING SYSTEM FOR ROVING BOBBIN REPLACING APPARATUS

[75] Inventors: Isao Asai; Toshinori Hasegawa, both of Kariya, Japan

[73] Assignee: Kabushiki Kaisha Toyoda Jidoshokki Seisakusho, Kariya, Japan

[21] Appl. No.: 24,909

[22] Filed: Mar. 2, 1993

Related U.S. Application Data

[63] Continuation of Ser. No. 646,685, Jan. 28, 1991, abandoned.

[30] Foreign Application Priority Data

Jan. 31, 1990 [JP] Japan ..... 2-23047

[51] Int. Cl.[5] ..... D01H 11/00; D01H 9/10

[52] U.S. Cl. ..... 57/305; 57/268; 57/276; 57/281; 57/300; 57/304; 57/306; 15/312.1

[58] Field of Search ..... 57/300-2, 304-6, 281, 266, 268, 270, 276; 57/307, 303, 301, 302, 303, 304, 305, 306, 281, 266, 268; 270; 15/312.2, 312.1

[56] References Cited

U.S. PATENT DOCUMENTS

| | | | |
|---|---|---|---|
| 3,304,571 | 2/1967 | Black | 15/312.2 |
| 3,368,338 | 2/1968 | Breuning | 57/304 X |
| 3,372,425 | 3/1986 | Black | 15/312.2 |
| 3,486,319 | 12/1969 | Lee et al. | 57/304 X |
| 3,762,143 | 10/1973 | Stewart | 57/304 X |
| 4,133,168 | 1/1979 | Keller et al. | 57/304 |
| 4,333,772 | 6/1982 | Mulligan et al. | 15/312.1 X |
| 4,435,876 | 3/1984 | Mulligan | 15/312.1 |
| 4,572,745 | 2/1986 | House | 15/312.2 X |
| 4,799,353 | 1/1989 | Kawasaki et al. | 57/281 |
| 4,821,504 | 4/1989 | Shinkai et al. | 57/266 X |

FOREIGN PATENT DOCUMENTS

| | | | |
|---|---|---|---|
| 213962 | 11/1987 | . | |
| 258188 | 2/1988 | . | |
| 1291668 | 3/1969 | Fed. Rep. of Germany | 57/304 |
| 1188285 | 9/1959 | France . | |
| 1382564 | 11/1964 | France . | |
| 1454628 | 10/1966 | France | 15/312.2 |
| 2502192 | 9/1982 | France . | |
| 4751649 | 12/1970 | Japan . | |
| 49-1668 | 1/1974 | Japan | 57/304 |
| 53-44582 | 11/1978 | Japan | 57/304 |
| 6257957 | 9/1985 | Japan . | |

*Primary Examiner*—Daniel P. Stodola
*Assistant Examiner*—William Stryjewski
*Attorney, Agent, or Firm*—Brooks Haidt Haffner & Delahunty

[57] ABSTRACT

A chip collecting system for a bobbin replacing apparatus wherein roving chips and fleece are temporarily accommodated in a chip collecting chamber of the bobbin replacing apparatus through a suction pipe. Upon arrival of the bobbin replacing apparatus to a position that opposes a chip removing system, a communicating member is connected to the chip removing system to communicate the chamber to the outside, whereupon the roving chips in the chamber are removed by the chip removing system.

9 Claims, 15 Drawing Sheets

ROVING CHIP COLLECTING SYSTEM FOR ROVING BOBBIN REPLACING APPARATUS

This application is a continuation of application Ser. No. 07/646,685, filed Jan. 28, 1991, now abandoned.

This application claims the priority of Japanese Patent Application No. 2-23047 filed Jan. 31, 1990, which is incorporated herein by reference.

BACKGROUND OF THE INVENTION (1) Field of the Invention

This invention relates to a roving chip collecting system for a roving bobbin replacing apparatus. More particularly, it relates to a chip collecting system for a bobbin replacing apparatus that performs the operation of replacing the bobbins under delivery using suction pipes.

(2) Description of the Related Art

In a spinning frame, particularly in a ring spinning frame, rovings are drawn from bobbins suspended from the creel and fed to drafting parts locating below the creel. When the bobbins become empty or nearly empty as the feeding of rovings to the drafting parts proceeds, these bobbins must be replaced with new roving bobbins. In carrying out this replacement, the tail ends of the rovings of new bobbins must be spliced with those of the bobbins under delivery, or the rovings of the new bobbins must be inserted into the drafting parts of the spinning frame.

In order to promote energy saving in the spinning process, a bobbin replacing apparatus (bobbin changer) has been proposed, for example, in Japanese Unexamined Patent Publication Mo. 62-57957, which performs the splicing or ending operation and bobbin replacing operation in sequence as it moves from one end to the other end of the spinning frame structure, and has already been put into practical uses. In this type of bobbin replacing apparatus, the tail ends of the rovings of new full bobbins (stand-by bobbins) are drawn out under suction and spliced with those of the bobbins under delivery (ending operation) by means of an ending device or splicer. In carrying out this operation, the tail ends of the rovings are trimmed so that the length of the rovings protruding from the holders of the splicer may be equal, and the chips of the rovings are collected in a roving chip collecting box or chamber provided in the bobbin replacing apparatus. When the chip collecting box is full, the roving chips are designed to be removed therefrom manually by an operator.

Since a number of spinning frames are installed in a spinnery within a limited space, smaller bobbin replacing apparatuses are in demand. Therefore, the capacity of the chip collecting chambers to be disposed in such apparatus is naturally limited. When a high yarn count is to be spun, the chip collecting chamber becomes full of chips after a single bobbin replacing operation for one spinning frame due to the great thickness of the rovings fed to the spinning frame. Accordingly, operators must frequently remove the roving chips from the chip collecting. Further, particularly when 100% cotton rovings or the like are used, which contain a large number of short fibers, the short fibers scatter when the roving chips are removed from the chip collecting chamber thereby contaminating the working environment.

SUMMARY OF THE INVENTION

A primary object of this invention is to provide a chip collecting system for a roving bobbin replacing apparatus, which can perform fully automatically recovery of roving chips from the chip collecting chamber provided in the bobbin replacing apparatus. In this connection, it is a further object of this invention to provide a chip collecting system in a bobbin replacing apparatus which enables reduction of total cost by saving labor and energy.

Another object of this invention is to provide a chip collecting system for a bobbin replacing apparatus, which requires less frequent removal of the roving chips even when the roving chips accumulated in the chip collecting chamber must be recovered manually.

According to one embodiment of this invention, a roving chip collecting system is provided for a bobbin replacing apparatus. The bobbin replacing apparatus replaces bobbins under delivery that are suspended from bobbin hangers on a creel of a spinning frame with full bobbins suspended from stand-by bobbin rails extended along the side edges of the creel as the bobbin replacing apparatus move longitudinally from a first end of the spinning frame to a second end thereof. Pick finding operations of picking up the tail ends of rovings from the full bobbins are carried out using a suction pipe in the bobbin replacing operation The chip collecting system includes a first chip collecting chamber disposed in the bobbin replacing apparatus. The chip collecting chamber temporarily holds the unnecessary roving chips and fleece generated during the pick finding operations. A communicating means is disposed in the chip collecting chamber for communicating between the chamber and the outside. A chip removing means removes the roving chips in the chip collecting chamber through the communicating means. The chip removing means is disposed on the route of the bobbin replacing apparatus and is selectively connectable with the communicating means.

As the chip removing system, a suction removal pipe connected at one end to a central chip/fleece collecting duct a chip collecting chamber or a pneumatic clearer provided at one end of the spinning frame can be utilized. In this case, the equipment already installed generally in the spinnery can be utilized to require minimal additional installation cost.

Alternatively, the chip removing system may consist of an independent chip collecting chamber disposed at one end of the spinning frame and a transferring means for transferring the roving chips in the chip collecting chamber of the bobbin replacing apparatus to the independent chip collecting chamber.

Further, according to another embodiment of this invention, the bobbin replacing apparatus is carried on a transporter and transported between the spinning frame structures. The bobbin replacing apparatus has a chip collecting chamber which temporarily accommodates the unnecessary roving chips generated during the pick finding operation, and the chamber has a communicating means which communicates the chip collecting chamber to the outside.

The transporter is also provided with a chip collecting chamber having connecting suction pipes which can be respectively connected to the pipes provided in the chip collecting chambers of the bobbin replacing apparatuses. And a second communicating pipe which communicates the chip collecting chamber of the transporter to the outside. A suction removal pipe is connected to a central chip/fleece collecting duct at a position on the route of the bobbin replacing apparatus along the row of the spinning frames. The suction removal pipe is connectable with the communicating pipe provided in the transporter. Since the chip collecting chamber of the transporter has a greater capacity than the chip collecting chamber of the bobbin replacing apparatus, the roving chips can be sucked away from the chip collecting chamber of the transporter less often. Moreover, the timing of exhausting the roving chips accumulated in the chip collecting chamber in the bobbin replacing apparatus into that of the transporter is adapted to be during the transportation of the bobbin replacing apparatus being carried on the transporter to another spinning frame structure needing the bobbin replacing operation. Accordingly the operation efficiency of the apparatus can be improved.

BRIEF DESCRIPTION OF THE DRAWINGS

FIGS. 1 to 6 illustrate a first embodiment of this invention wherein FIG. 1 is a schematic side view, FIG. 2 a schematic plan view, FIG. 3 a back view showing the relationship between the spinning frame and the bobbin replacing apparatus, FIG. 4 a schematic side view showing how the exhaust pipe and the suction removal pipe are connected, FIG. 5 a partial side view of the suction removal pipe, and FIG. 6 a partial plan view of the suction removal pipe.

FIGS. 7 to 10 illustrate a second embodiment of this invention wherein FIG. 7 is a schematic side view, FIG. 8 a schematic plan view, FIG. 9 a back view showing the relationship between the spinning frame and the bobbin replacing apparatus, and FIG. 10 a schematic side view showing how the exhaust pipe and the suction removal pipe are connected.

FIGS. 13 to 15 illustrate a fifth embodiment of this invention wherein FIG. 13 is a schematic plan view, FIG. 14 a schematic side view, and FIG. 15 a schematic back view.

DETAILED DESCRIPTION OF PREFERRED EMBODIMENTS

Example 1

Figure 3:
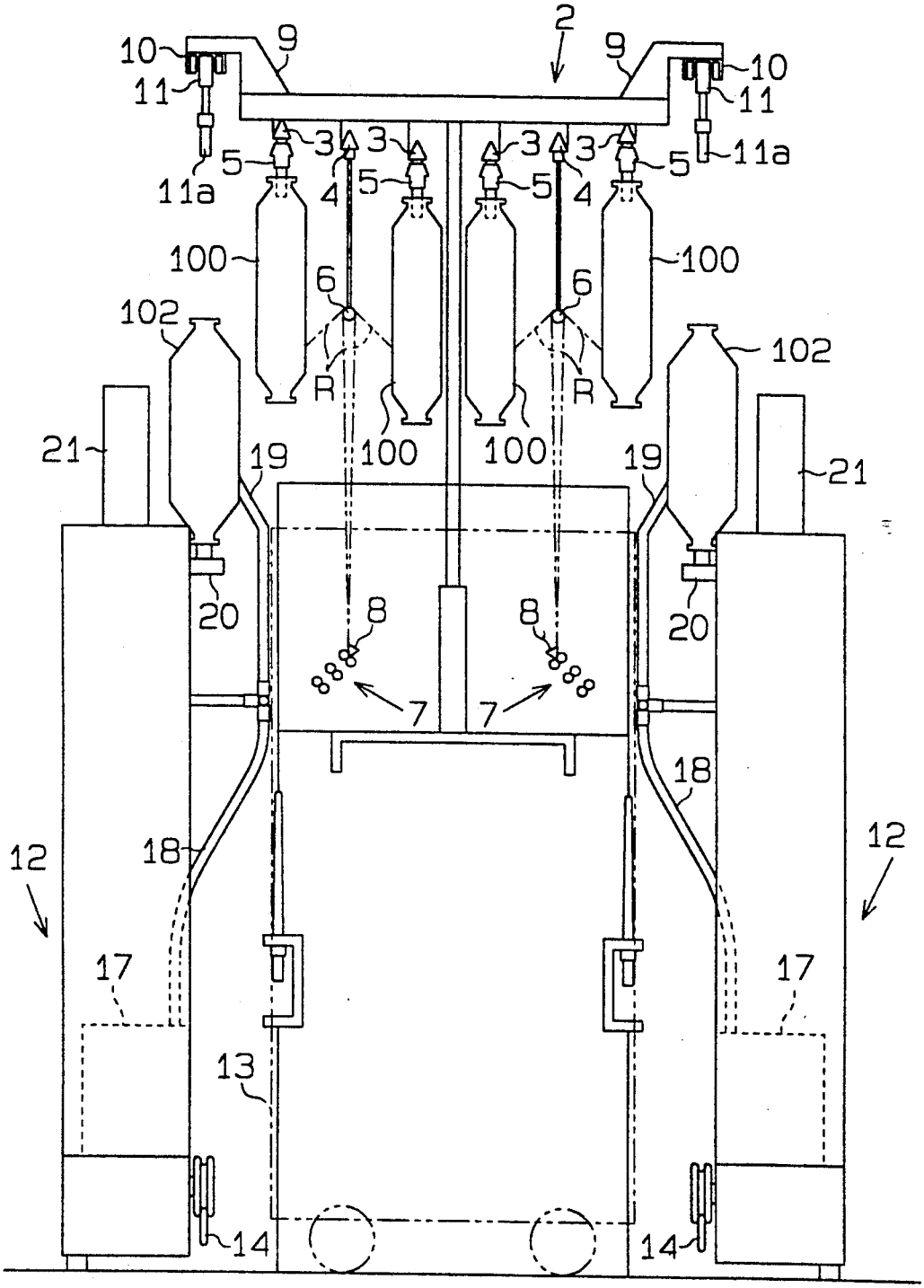

A first embodiment of this invention will specifically be described below referring to FIGS. 1 to 6. As shown in FIG. 3, two pairs of bobbin rails 3 extend in parallel on a creel 2 of a spinning frame 1 in the longitudinal direction of the spinning frame structure. Each pair of bobbin rails consists of an inner rail and an outer rail. A creel rail 4 is provided between each pair of the rails 3 and is parallel therewith. Each bobbin rail 3 has bobbin hangers 5 attached thereto at predetermined intervals corresponding to the doubled spindle pitch. The rovings R drawn from the bobbins 100 suspended from the bobbin hangers 5 are designed to be guided through roving guides 6 to the trumpets 8 of drafting parts 7.

A pair of brackets 9 extend outward from the side edges of the creel 2, and stand-by bobbin rails 10 are provided along the brackets 9 to be parallel with the bobbin rails 8. From the rails 10, runners 11 each having a bobbin hanger **11*a* are suspended so that they can run along the rails 10**.

A couple of roving bobbin replacing apparatuses 12 are loaded on each side of a transporter 13 which travels along one side of the row of spinning frames The transporter 13 transports the apparatuses 12 to a predetermined position where they oppose a corresponding spinning frame 1 needing a bobbin replacing operation. When the transporter 13 reaches this position, the apparatuses 12 are unloaded and travel along the rails 14 so that they may perform the bobbin replacing operation and ending operation.

Figure 4:
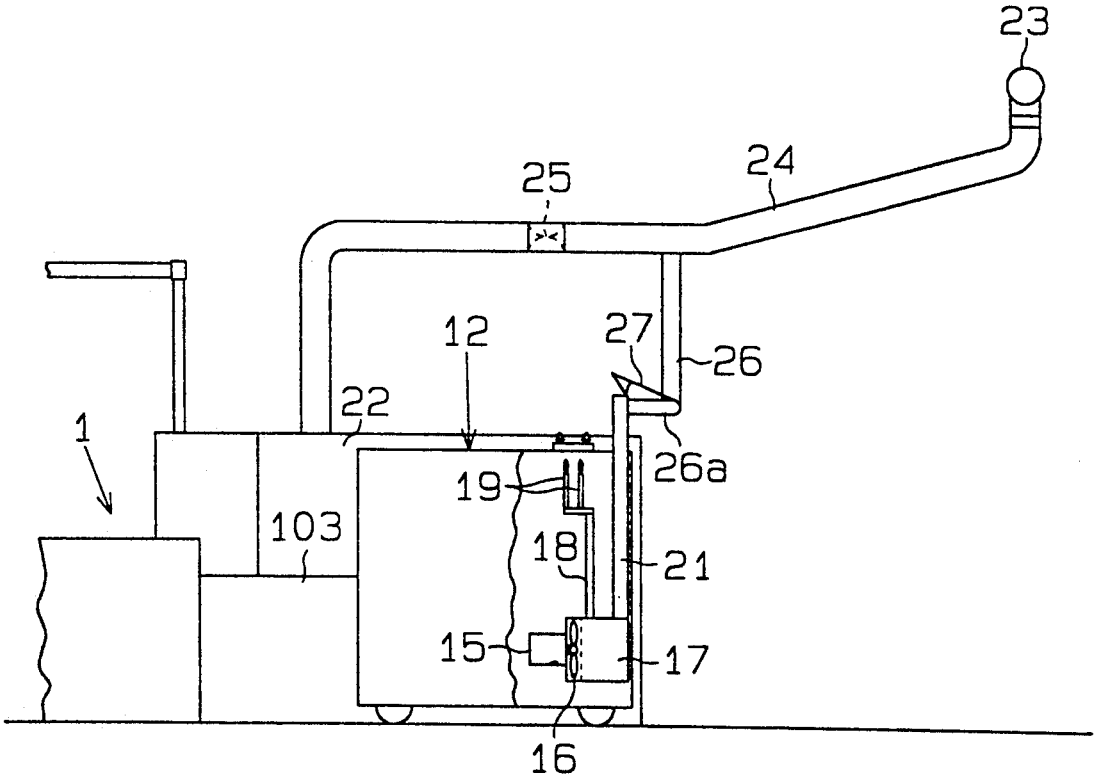

The bobbin replacing apparatus 12 has a splicer (not shown) and a bobbin changer (not shown). The apparatus 12 also has a pick finding unit which picks up the tail end of the roving from a full bobbin 102 in the bobbin replacing operation. The pick finding unit consists of a chip collecting box 17 as a chip collecting chamber, a suction pipe 18 connected at the lower end to the box 17 and a suction nozzles 19 provided at the upper end of the suction pipe 18. The chip collecting box 17 is disposed at the bottom of the apparatus 12 and has a suction fan 16 driven by a motor 15, as shown in FIG. 4.

In the inside of the suction nozzle 19, a roving cutter (not shown) of a known construction (e.g. as disclosed in Japanese Patent Publication No. 47-51649) is provided for trimming the roving R sucked into the suction nozzle 19. The suction nozzle 19 is disposed so as to be shifted by a drive mechanism (not shown) between a pick finding position which corresponds to the level of the lower end of the full bobbin 102 carried to the position where pick finding is carried out and a descended position where the roving sucked from the full bobbin 102 is drawn to a predetermined position so that the splicer (not shown) can easily hold the roving. The full bobbin 102 is designed to be released by a carriage 20 from the bobbin hanger **11*a* of the runner 11 and carried to the pick finding position (see FIG. 3**).

Figure 1:
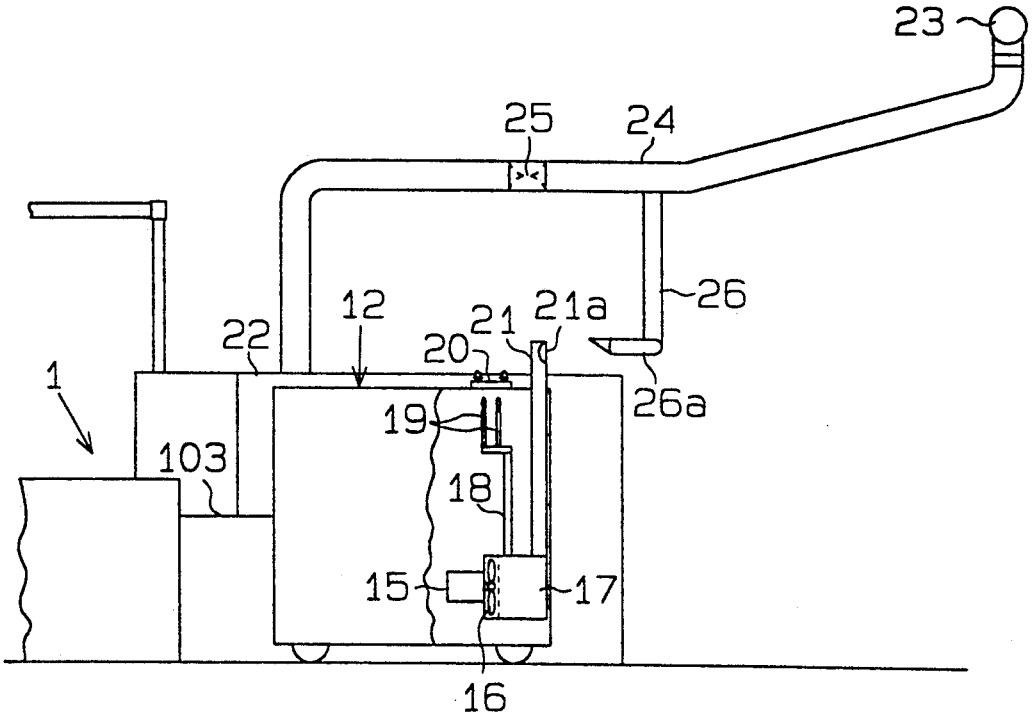
Figure 2:
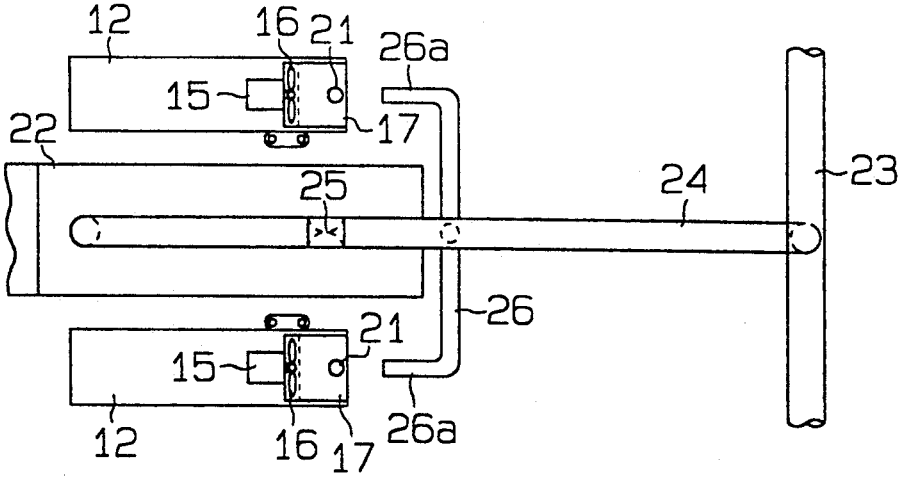

An exhaust pipe 21 protrudes from the upper surface of the bobbin replacing apparatus 12 at a position closer to one end thereof. As shown in FIG. 1, an outlet **21*a* is formed near the upper end of the exhaust pipe 21 on the outer end side of the spinning frame 1. Further, a shutter (not shown) which is openable only toward the outlet 21*a* is provided at the lower end of the exhaust pipe 21 so that the outlet 21*a* is not affected by the suction force of the suction fan 16**.

The spinning frame 1 has a pneumatic clearer (not shown), and a pneumatic box 22 is provided on the end side 103 of the spinning frame 1 as a source of suction force. The pneumatic clearer sucks fleece fed from the drafting parts 7 whenever end down occurs during the spinning operation so as to prevent the fleece from affecting other spindles. The pneumatic clearer also functions to remove the flock deposited on the front bottom rollers during the normal operation.

A central chip/fleece collecting duct 23 is arranged at the ceiling on the end side 103 of the spinning frame 1. The collecting duct 23 is connected to the pneumatic box 22 through a duct 24. The duct 24 has a valve 25 in the middle thereof so that the suction force from the central collecting duct 23 exerted to the pneumatic box 22 can be controlled.

A suction removal pipe 26 is connected as a chip removing system to the duct 24 at a position closer to the central duct 23 than the valve 25. The suction removal pipe 26 exerts suction force to the chip collecting box 17 through the suction pipe 21 to suck away the roving chips in the box 17

The suction removal pipe 26 is diverged into two parts and the tips thereof extend horizontally toward the spinning frame structure at the level of the outlets 21*a*. The inlet 26*a* of the suction removal pipe 26 has arcuately cut sides, as shown in FIG. 5, and covered with a door 27 which can be opened or closed automatically.

Figure 5:
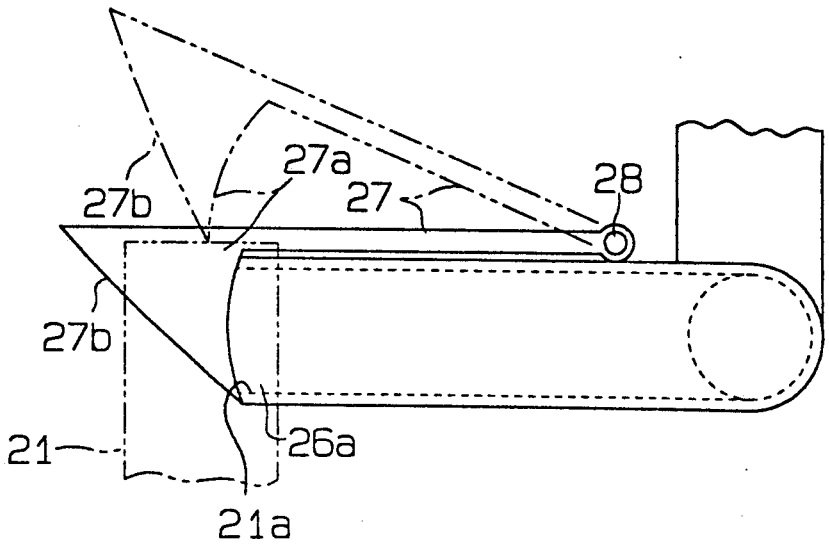
Figure 6:
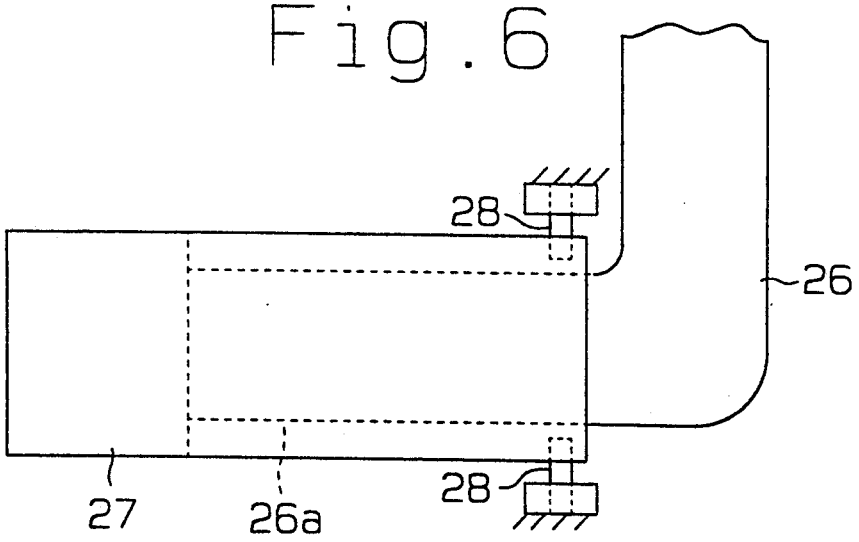
Figure 7:
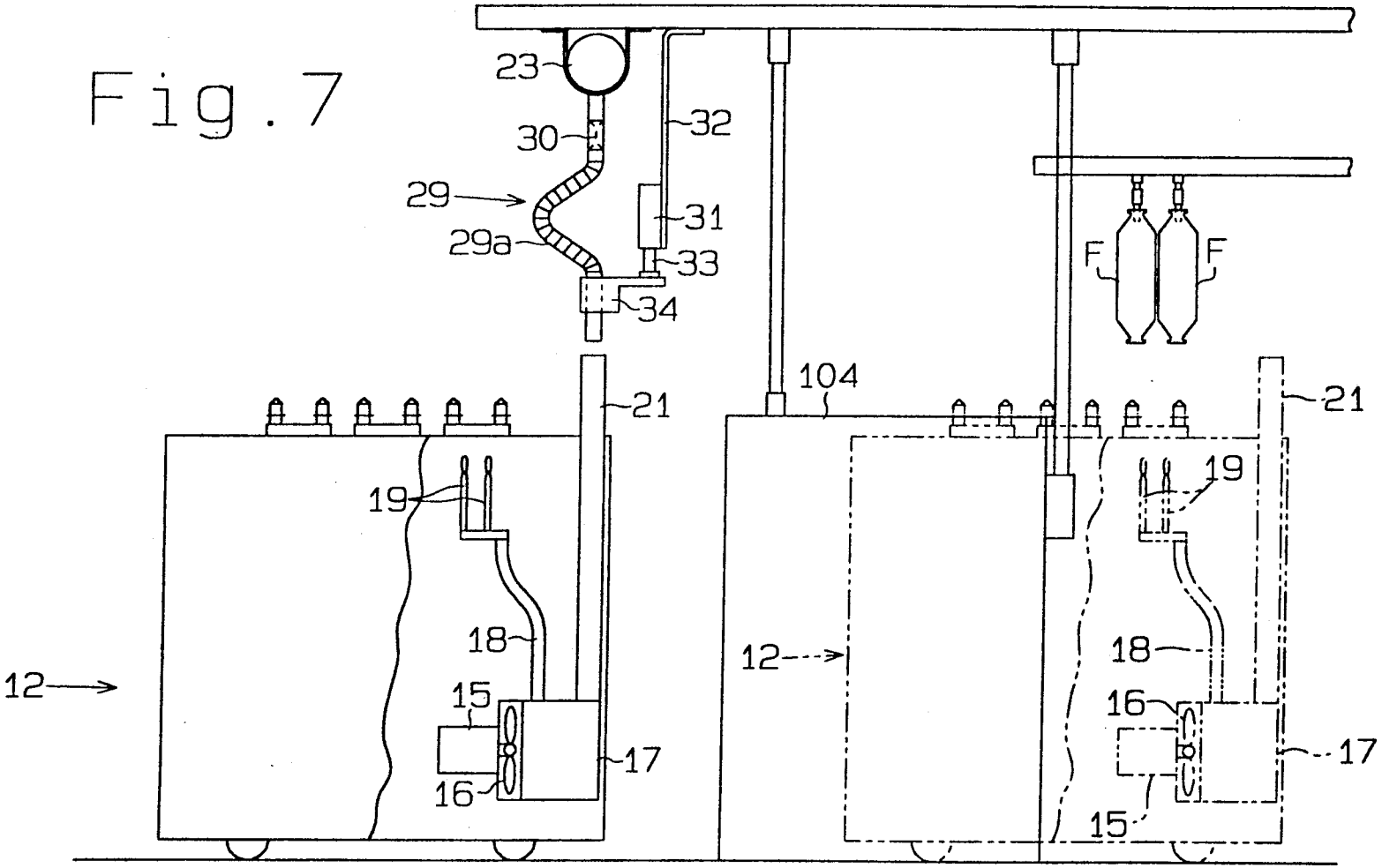
Figure 8:
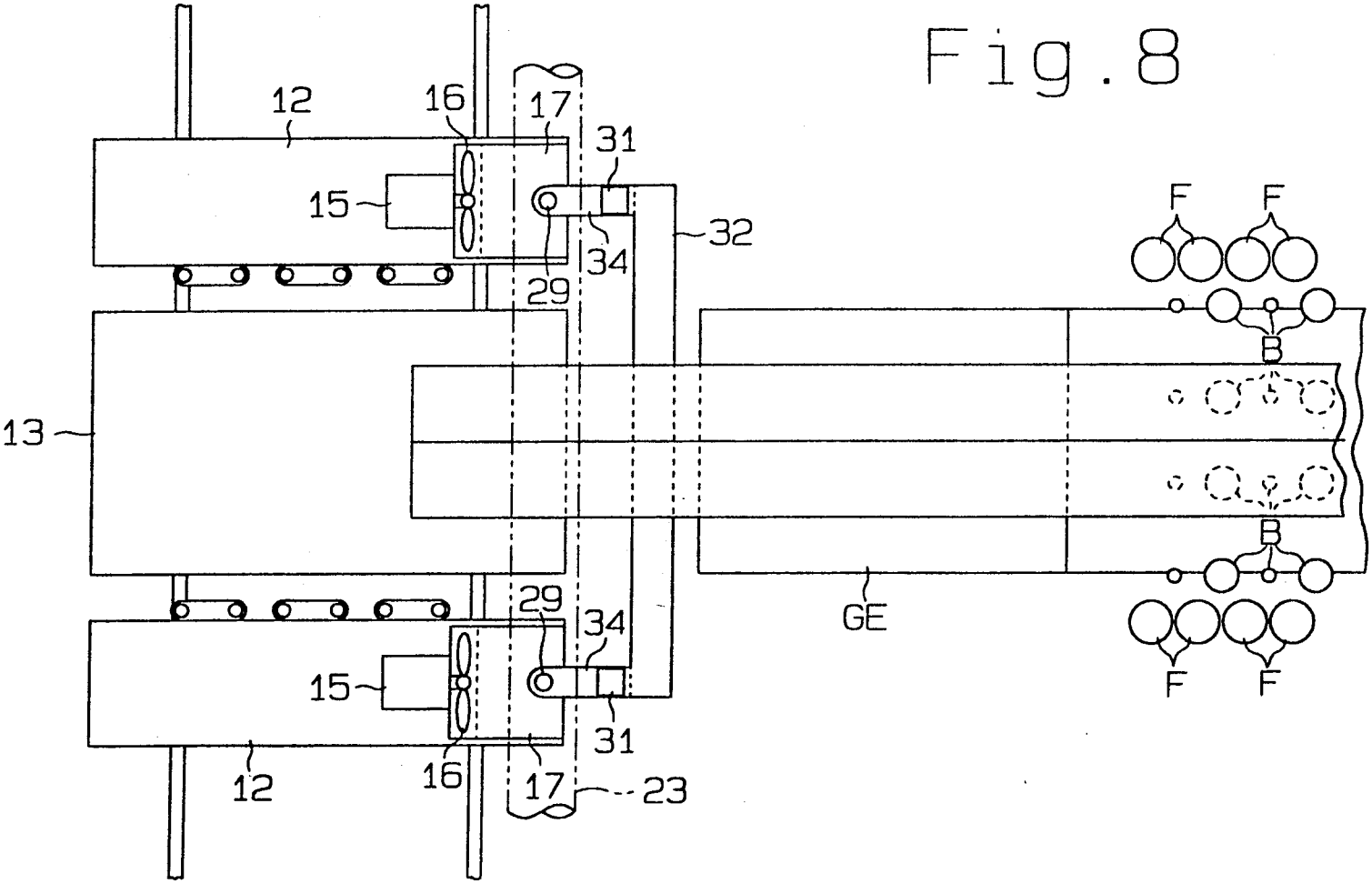
Figure 9:
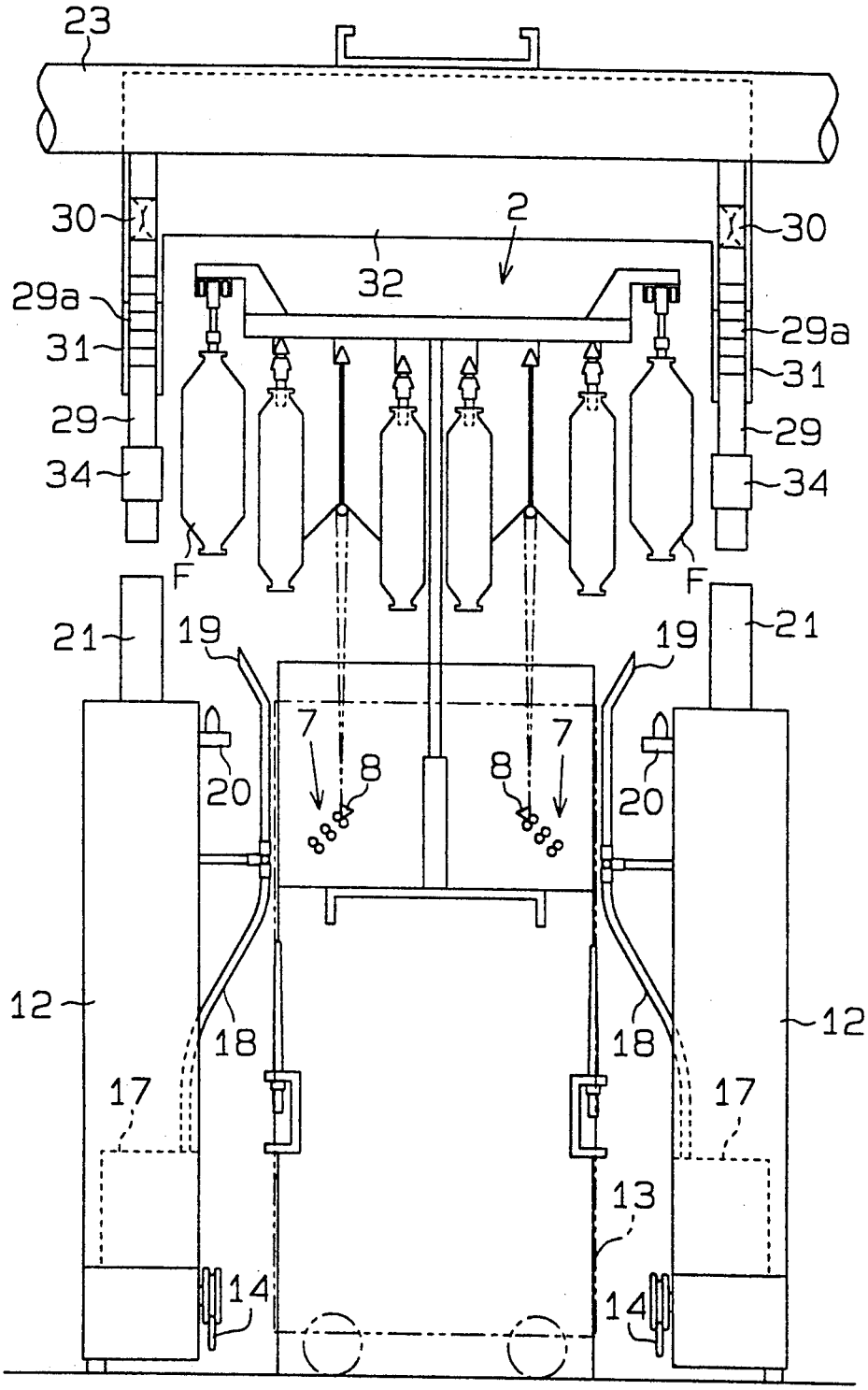

The door 27 is pivotally supported at one end by a shaft 28 as shown in FIGS. 5 and 6 and has a cover 27*a* which can be brought into slide contact with the end face of the inlet 26*a*. The other end or front face of the cover 27*a* has an engaging face 27*b* having a slope of approximately 45°. As the exhaust pipe 21 moves horizontally toward the suction removal pipe 26, the upper end of the pipe 21 engages with the engaging face 27*b*, and when the exhaust pipe 21 as such moves further toward the suction pipe 21, the closed door 27 is pivoted to assume an open posture as shown by the dashed line in FIG. 5.

Now, the operation of the bobbin replacing apparatus having the above constitution will be described. First, bobbin replacing apparatuses 12 are loaded on each side of the transporter 13 and transported to a predetermined position where they oppose to a corresponding spinning frame 1 needing bobbin replacing operation. At this position, the apparatuses 12 are unloaded from the transporter 13 and move toward the spinning frame 1 along the rails 14 extended on each side of the spinning frame 1 to carry out the bobbin replacing operation and ending operation in sequence.

In the bobbin replacing operation, as shown in FIG. 3, the suction nozzle 19 of the pick finding device is shifted to the pick finding position which corresponds to the level of the lower end of the full bobbin 102 to suck and find the tail end of the roving R from the full bobbin 102. When the roving R sucked in the suction nozzle 19 is too long, it is trimmed with a roving cutter. The chips of the rovings R are accommodated in the chip collecting box 17 through the suction pipe 18 under the action of the suction fan 16.

After completion of the bobbin replacing operation, the suction fan 16 is stopped, and the bobbin replacing apparatuses 12 are moved a predetermined position where they oppose to the suction removal pipe 26 disposed on the end side 103 of the spinning frame 1. Now that the apparatuses 12 are moved to a predetermined position, the inlet 26*a* of the suction removal pipe 26 is inserted into the outlet 21*a* to connect the exhaust pipe 21 with the suction removal pipe 26. The suction force of the central collecting duct 23 is thus exerted to the inside of the chip collecting box 17 through the suction removal pipe 26 and the exhaust pipe 21, whereupon the roving chips R accumulated in the chip collecting box 17 are sucked away through the exhaust pipe 21 and the suction removal pipe 26 into the central collecting duct 23. The thus recovered roving R chips are transferred through the duct 23 to a raw stock feeding chamber for recycling.

The valve 25 is closed upon receipt of a detection signal from a detector (not shown) when the bobbin replacing apparatuses 12 reach the predetermined position. When the valve 25 is closed, the suction force exerted from the central collecting duct 23 to the suction removal pipe 26 is increased to ensure complete sucking of the chip accumulated in the chip collecting box 17.

After a predetermined time (several seconds), the bobbin replacing apparatuses 12 start to move toward the gear end side (opposite to the end side 103) and are loaded again on the transporter 13 waiting on the gear end side to be transported to a predetermined position where they oppose another spinning frame 1 needing the bobbin replacing operation, where the above operation is repeated. As described above, the roving chips accommodated in the chip collecting box 17 of the bobbin replacing apparatus can be recovered fully automatically. Therefore, operators need not remove the roving chips manually, leading to labor saving and reduction in the total cost.

Every time the bobbin replacing apparatus 12 completes the bobbin replacing operation for one spinning frame 1, the chips accumulated in the chip collecting box 17 are sucked away automatically. Accordingly, the amount of the roving chips that are temporarily accommodated in the chip collecting box 17 can be held below a predetermined level with no substantial reduction in the suction force (both in gas volume and static pressure) of the suction fan 16, whereby the suction force can be exerted with stability to reduce miss in the pick finding operation. Moreover, since the size of the chip collecting chamber in the bobbin replacing apparatus 12 and that of the suction fan 16 can further be reduced, power consumption can be moderated to further reduce the total cost.

In this embodiment, since the central collecting duct 23 uses the pneumatic apparatus already installed in the spinnery the installation cost will be very small.

Example 2

Now, a second embodiment of this invention will be described referring to FIGS. 7 to 10. In this embodiment, the significant difference from the first embodiment is that the chip removing system is located on the gear end side 104 of the spinning frame 1. In the construction of the bobbin replacing apparatus 12, the only difference is that the exhaust pipe 21 has an open upper end.

A central collecting duct 23 is disposed above the spinning frame 1 on the gear end side 104. The duct 23 has a suction removal pipe 29 connected at a position where it opposes the exhaust pipe 21 of the bobbin replacing apparatus 12 loaded on the transporter 13. The suction removal pipe 29 has a bellows 29*a* in the middle and a valve 30 at a position closer to the upper end. An air cylinder 31 extending vertically from a bracket 32 is disposed beside the suction removal pipe 29. A holder 34 to which the lower end of the suction removal pipe 29 is inserted is secured on the lower end of the piston rod 33 of the cylinder 31. The suction removal pipe 29 is designed to be shiftable between a position where it is connectable with the exhaust pipe 21 and a position where it is spaced from the exhaust pipe 21 with the movement of this piston rod 33.

Figure 10:
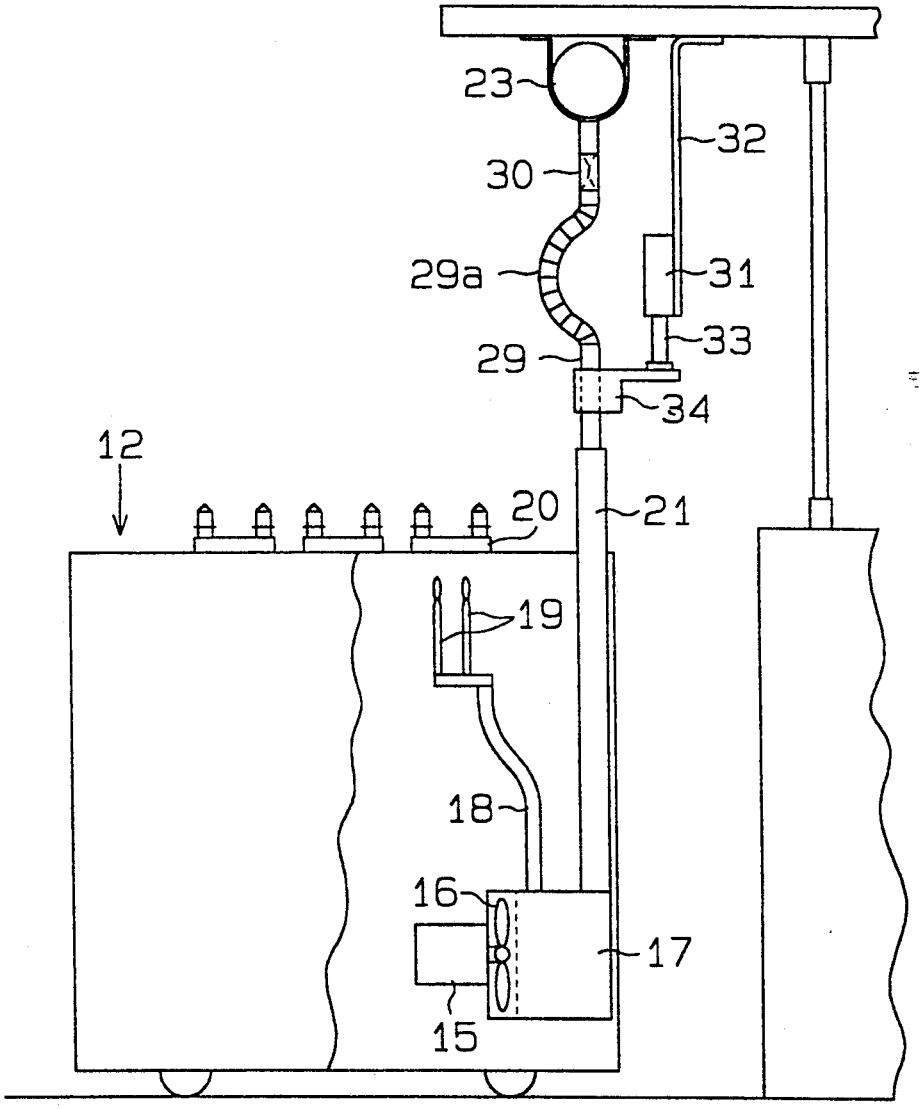

In this embodiment, the valve 30 is normally closed and the piston rod is retracted. When the bobbin replacing apparatuses 12 return to the position in alignment with the transporter 18 (after completion of the bobbin replacing operation for one spinning frame 1), the air cylinder 31 is actuated to extend the piston rod 33. This connects the suction removal pipe 29 to the exhaust pipe 21, as shown in FIG. 10. In this state, the valve 30 may be opened to remove the roving chips accumulated in the chip collecting box 17. Specifically, when the valve is opened the suction force channeled through central collecting duct 23 is applied to the suction removal pipe 29 which sucks the roving chips from chip collecting box 17.

Example 3

Figure 11:
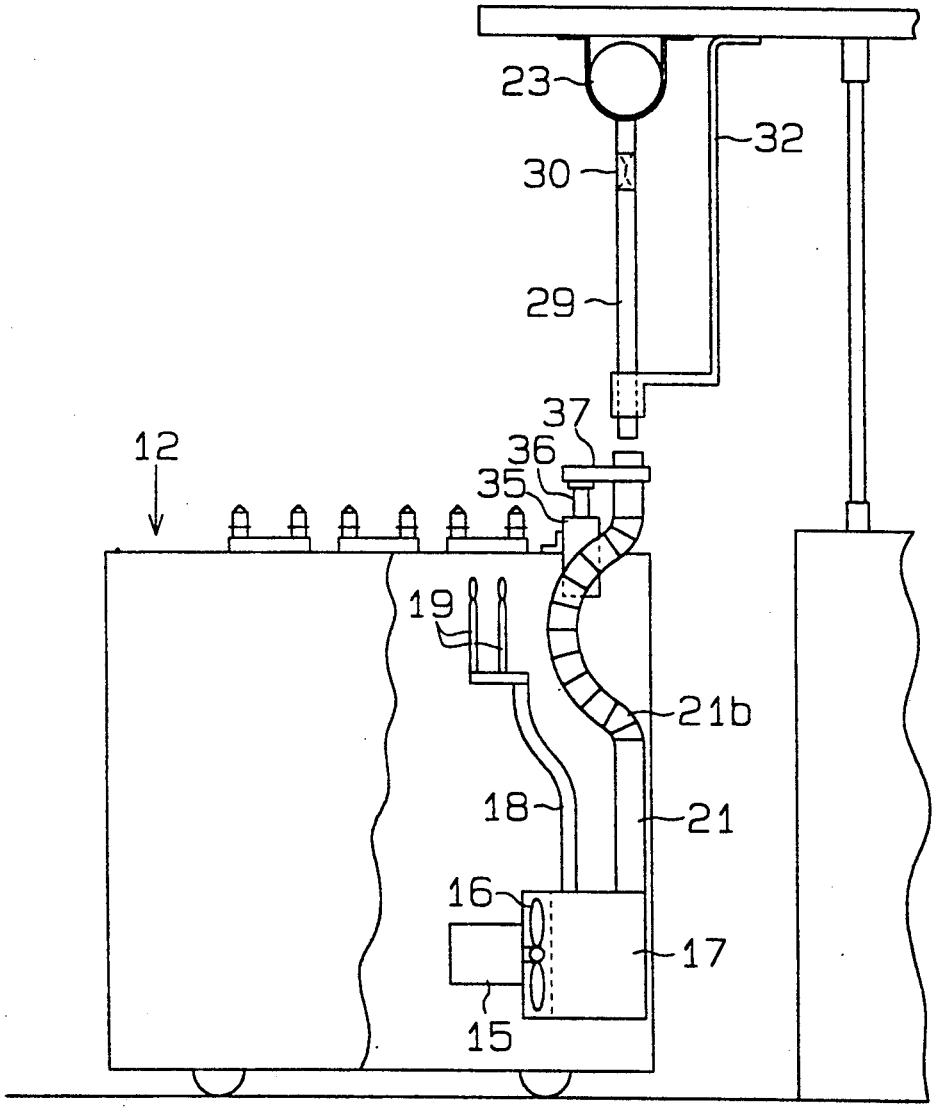
FIG. 11 shows a schematic side view of a third embodiment of this invention.

Next, a third embodiment of this invention will be described referring to FIG. 11. In this embodiment, what is different from the second embodiment is that the exhaust pipe 21 of the bobbin replacing apparatus 12 has an extensible construction, while the suction removal pipe 29 is fixed at a predetermined position. Namely, the lower end of the suction removal pipe 29 is secured at the predetermined position by a bracket 32. On the other hand, an air cylinder 35 is fixed at an upper part of the bobbin replacing apparatus 12, on the piston rod 36 of which an exhaust pipe 21 is fixed through a holder 37. The exhaust pipe 21 has a bellows **21*b*** so that it can be extended or retracted.

In this embodiment, upon returning of the bobbin replacing apparatuses 12 to the position in alignment with the transporter 13 after completion of the bobbin replacing operation for one spinning frame 1 like in Example 2, the air cylinder 35 is actuated to connect the suction removal pipe 29 with the exhaust pipe 21. The valve 30 is then opened to remove the roving chips accumulated in the chip collecting box 17. The suction removal pipe 29 in the second embodiment has an extensible construction, so that the air cylinder 31 for extending or retracting the pipe 29 must be disposed on the gear end side 104 of the spinning frame 1. However, in this embodiment, since the exhaust pipe 21 is extensible, the single air cylinder 35 provided on the bobbin replacing apparatus 12 enables connection between the suction removal pipe 29 and the exhaust pipe 21 only by allowing the bobbin replacing apparatuses 12 to oppose the spinning frame 1. Accordingly, the number of air cylinders can be reduced, and the control circuit for actuating the air cylinder is simplified. Therefore, a simplified structure and reduced production costs can be realized.

Example 4

Figure 12:
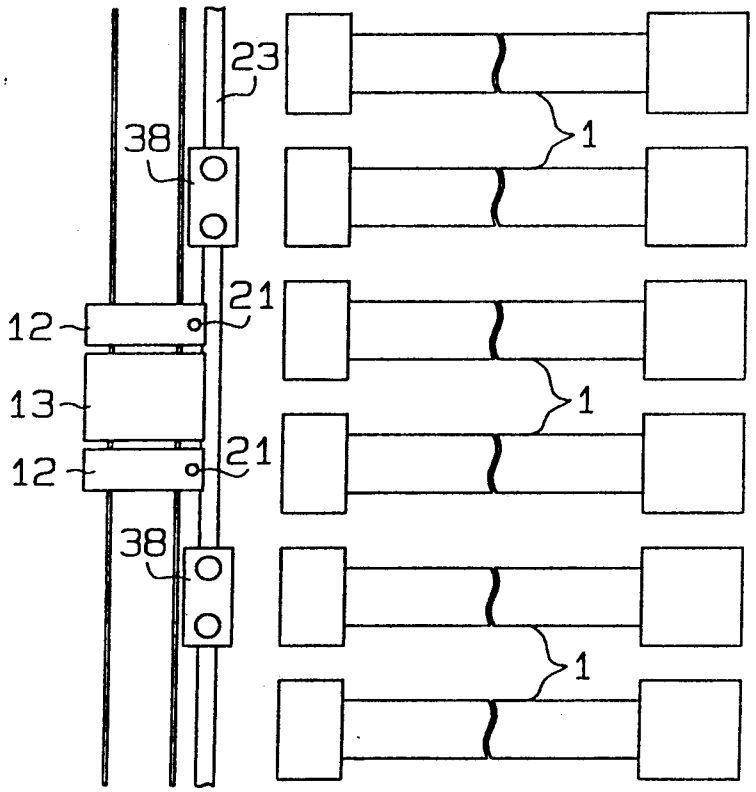
FIG. 12 shows a schematic plan view of a fourth embodiment of this invention.

A fourth embodiment of this invention will now be described referring to FIG. 12. The suction removal pipe 26 or 29 is disposed as a chip remover for removing the roving chips accumulated in the chip collecting box 17 in the end portion of each spinning frame 1 in the preceding Examples. In this embodiment, however, what is significantly different from the preceding embodiments is that the number of the chip removing systems used is smaller than the number of the spinning frames 1. Specifically, in this embodiment, a suction removal station 38 is provided for every three spinning frames 1, and the station 38 has a suction removal pipe (not shown) of the construction described in the second and third embodiments. The bobbin replacing apparatuses 12 each have an exhaust pipe 21 having a construction engagable with the suction removal pipe of the suction removal station 38. When the apparatuses 12 are transported to the predetermined position where they oppose the corresponding station 38, the roving chips accumulated in the chip collecting box 17 are sucked away in the same manner as in Example 2 or 3.

The amount of the roving R chips to be temporarily accommodated in the chip collecting chamber 17 after a single bobbin replacing operation for one spinning frame 1 depends on the number of yarns to be spun. When a large number of yarns are to be spun, the chip collecting box 17 will be full after only one or two runs of the bobbin replacing operation. In contrast when fewer yarns are to be spun, it will fill only after several runs. Accordingly, when a small number of yarns are to be spun, it is not necessary to remove the roving chips from the chip collecting chamber 17 after completion of one or two runs of the bobbin replacing operation. Rather, removal of chips may be carried out whenever the bobbin replacing apparatuses 12 reach the position where they oppose to the suction removal station 38.

However, when a large number of yarns are to be spun, the roving chips in the chip collecting box 17 must be removed after completion of the bobbin replacing operation once or twice. If the bobbin replacing operation is continued without removing the roving chips accumulated in the chip collecting chamber 17, sucking performance will be lowered which increases the probability of a pick finding miss.

In order to obviate such inconvenience in spinning a large number of yarns, the bobbin replacing apparatuses 12 are transported to a position where they oppose the corresponding suction removal station 38 after completion of one or two runs of the bobbin replacing operation to perform chip removing operations. The apparatuses 12 are then transported to another spinning frame 1 needing the bobbin replacing operation, where they repeat the necessary operation.

In carrying out the above procedure, the time required for transporting the bobbin replacing apparatuses 12 loaded on the transporter 13 to the suction removal station 38 or to a predetermined position to oppose a corresponding spinning frame 1 is very short. The time required for the chip removal is also very short, so that the smooth operation of the spinning frames 1 may not be disturbed thereby.

In the above construction, it is also possible to allow the bobbin replacing apparatus 12 to have a counter for counting the run number of bobbin replacing operations, so that the transporter 13 may transport the bobbin replacing apparatus to a predetermined position where it opposes to a corresponding suction removal station 38 upon receipt of a signal from the counter and to carry out chip removing operations there. The counter gives a signal whenever the run number of the bobbin replacing operation reach a predetermined value indicating the necessity of chip removal. In this case, the number of the suction removal stations 38 can further be reduced. Since the value depends on the spinning condition, a variable counter should be used so that the set value can be varied. The suction removal stations 38 may be disposed at positions that do not oppose to any spinning frame 1.

Example 5

Figure 13:
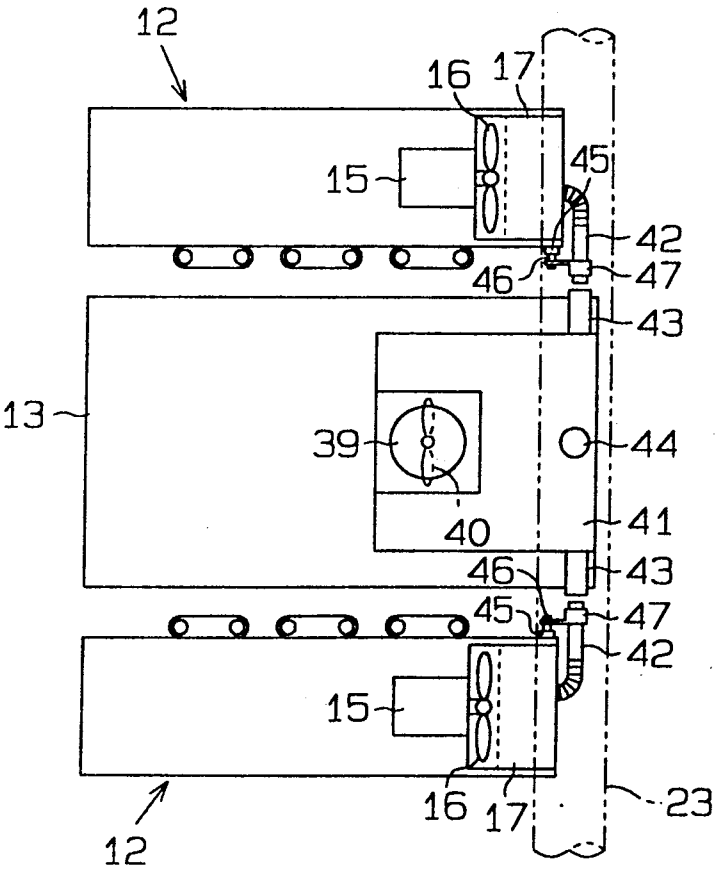
Figure 14:
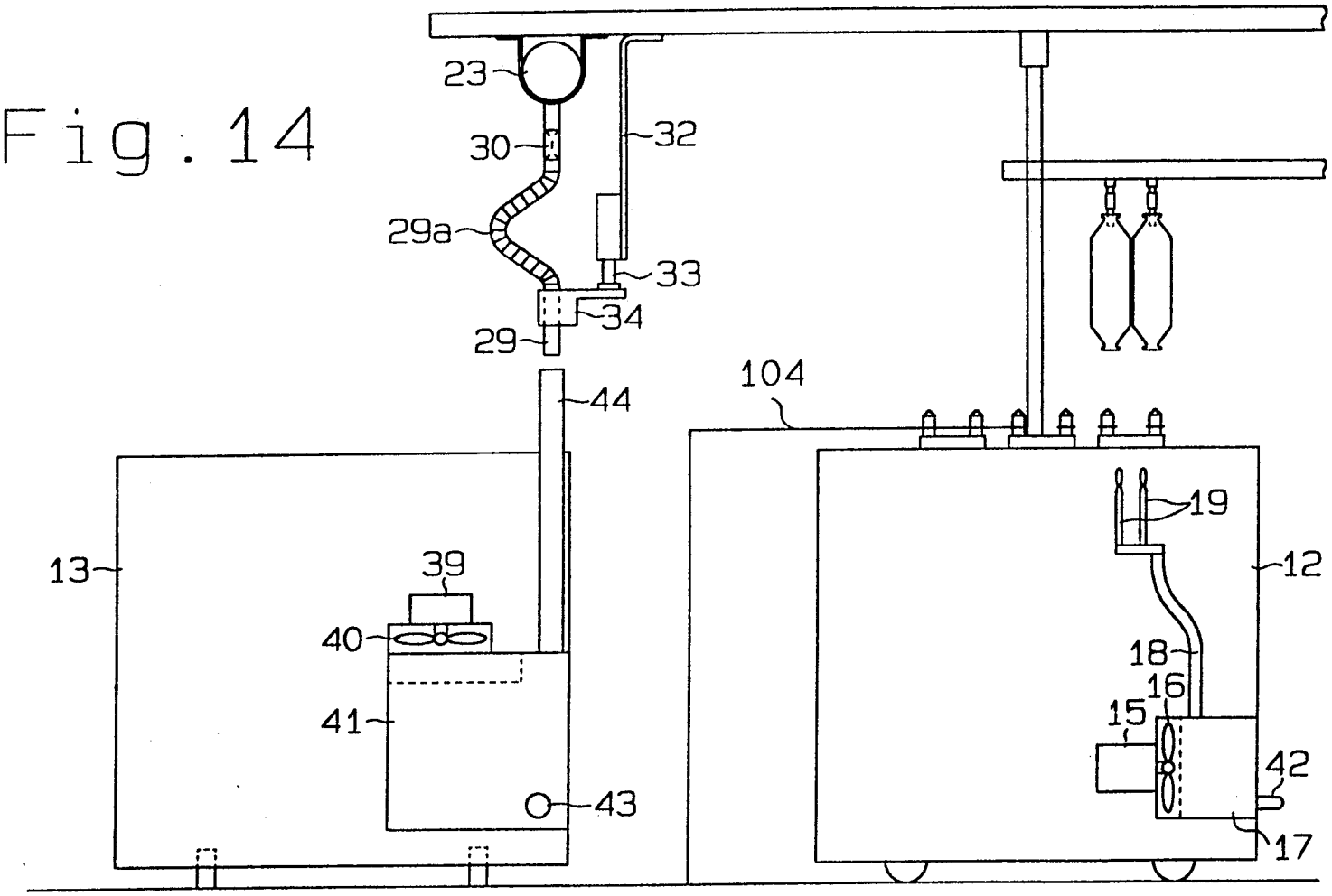
Figure 15:
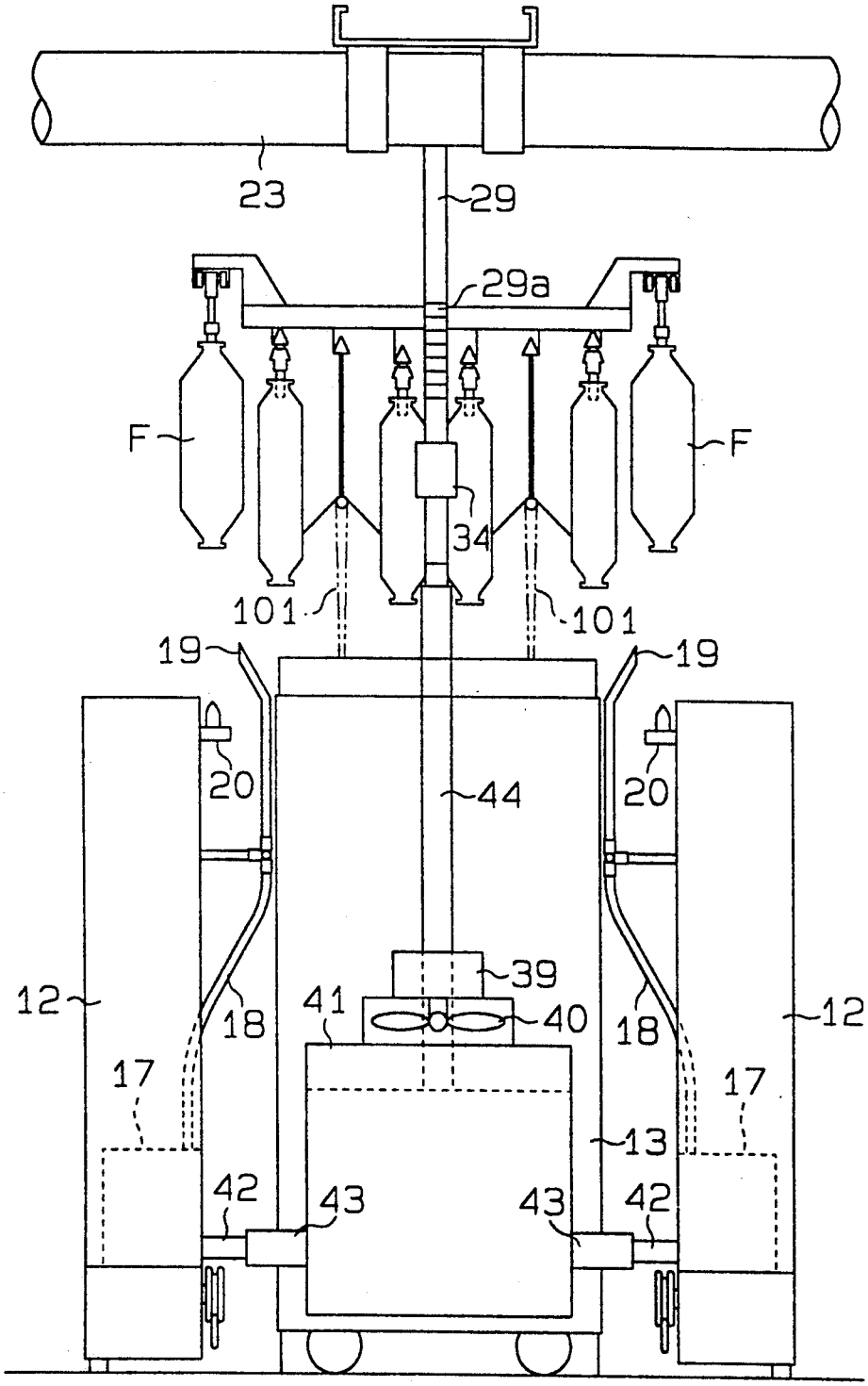

Next, a fifth embodiment of this invention will be described referring to FIGS. 13 to 15. What is significantly different in this embodiment from any of the preceding Examples is that chips of the rovings R temporarily accumulated in the chip collecting box 17 of each bobbin replacing apparatus 12 are accommodated in a chip collecting chamber 41 provided in the transporter 13 and are then sucked therefrom by a suction removal means.

A suction fan 40 driven by a motor 89 is disposed on the top of the chip collecting chamber 41 disposed in the transporter 13 at a position closer to the spinning frame 1. The chip collecting chamber 41 has a size greater than that of the chip collecting box 17. Connecting suction pipes 43 are connected to the chamber 41 so as to extend horizontally from each side thereof as a means for connecting the chamber 41 with the box 17 for sucking away the roving chips therefrom. Each connecting suction pipe 43 is adapted to be connected with an extensible exhaust pipe 42 connected to the chip collecting box 17. An exhaust pipe 44 extends upward from the upper part of the chip collecting chamber 41 as a means for communication.

An air cylinder 45 is fixed in the lower part of each bobbin replacing apparatus 12 beside the corresponding connecting suction pipe 43. The free end portion of the exhaust pipe 42 is secured on the piston rod 46 of the air cylinder 45 through a holder 47.

A central collecting duct 28 is disposed above the spinning frame 1 on the gear end side 104, and a suction removal pipe 29 having a construction similar to that of the second embodiment is connected thereto at a predetermined position where it opposes the exhaust pipe 44. With the movement of the piston rod 33, the suction removal pipe 29 is adapted to be shifted between a position where it is connectable with the exhaust pipe 44 and a position where it is spaced from the exhaust pipe 44. A separate suction removal pipe 29 is not provided for each of the spinning frames 1. Rather a single pipe 29 is shared by a plurality of spinning frames 1. In this embodiment, the bobbin replacing apparatuses 12 return to the position in alignment with the transporter 13 after completion of the bobbin replacing operation for one spinning frame 1. The air cylinder 45 is then actuated to protrude the piston rod 46, whereby the exhaust pipe 42 is connected to the connecting suction pipe 43. A suction fan 40 in the transporter 13 is then driven and the roving chips accumulated in the chip collecting box 17 are sucked away into the chip collecting chamber 41 under the suction force exerted by the fan 40. After completion of the chip removing operation, the piston rod 46 is retracted to remove the connection between the exhaust pipe 42 and the connecting suction pipe 43. The above operation may be carried out before the bobbin replacing apparatuses 12 start the next bobbin replacing operation, and it is actually carried out while the bobbin replacing apparatuses 12 are transported by the transporter 13 to another spinning frame 1 needing the bobbin replacing operation, allowing the apparatuses 12 to start the operation immediately after arrival at the position where they oppose the corresponding spinning frame 1 needing the bobbin replacing operation.

The roving chips recovered by the chip collecting chamber 41 are occasionally exhausted during the operation of the apparatuses 12. After the transporter 13 is stopped at a predetermined position where it oppose the suction removal pipe 29, the air cylinder 31 is actuated to protrude the piston rod 33, thereby connecting the suction removal pipe 29 with the exhaust pipe 44. By opening the valve 30 the roving chips in the chip collecting chamber 41 are sucked away by the suction force from the central collecting duct 23 through the exhaust pipe 44 and the suction removal pipe 29.

Since the chip collecting chamber 41 of the transporter 13 may have a capacity considerably greater than that of the chip collecting box 17 in the bobbin replacing apparatus 12, the operation of removing the roving chips from the chip collecting chamber 41 may be carried out less frequently than in any of the preceding Examples. However, the time required for one chip removing operation will be somewhat longer. Nevertheless, it may not affect the operation of the bobbin replacing apparatuses 12 since recovery of the chips from the chip collecting chamber 41 can be carried out while the apparatuses 12 are under operation. Suction removal pipes 29 may be disposed at one or two positions to carry out chip removal if the transporter 13 is adapted to travel to such positions during its stand-by period while the apparatuses 12 are performing bobbin replacing operation. By making the exhaust pipe 44 is carried by the transporter 13 as in this embodiment, the number of the pipes 29 can be reduced to ½ compared with the case where the exhaust pipe 21 is disposed on the bobbin replacing apparatus 12.

Example 6

Figure 16:
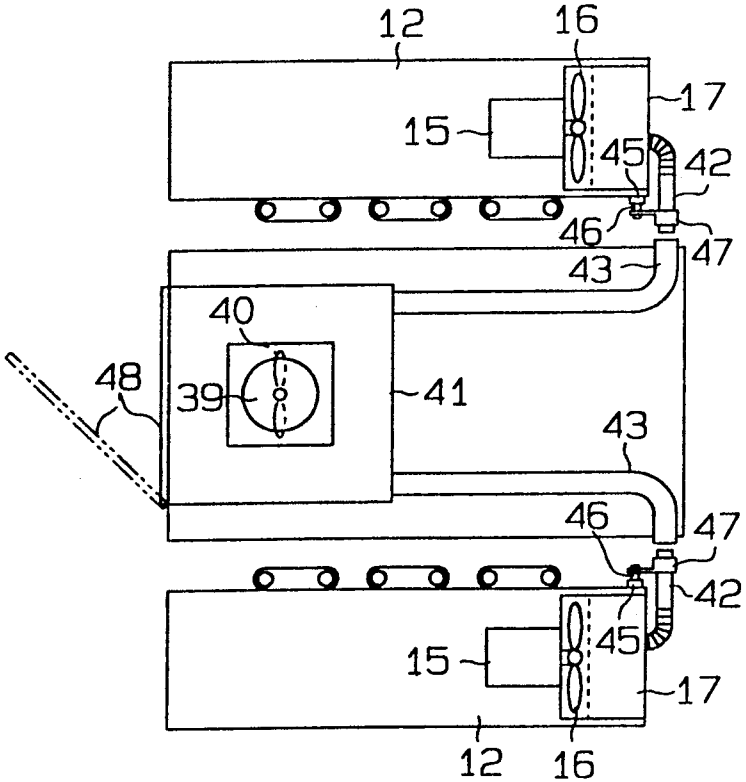
FIG. 16 shows a schematic plan view of a sixth embodiment of this invention.

A sixth embodiment of this invention will now be described referring to FIG. 16. In this embodiment, the construction of the bobbin replacing apparatus 12 is not modified but the roving chips accumulated in the chip collecting chamber 41 provided in the transporter 13 are adapted to be recovered by an operator. The chip collecting chamber 41 is disposed in the transporter 13 on the side opposite to the gear end side 104, and a connecting suction pipe 43 is extended to be connectable to the chamber 41. The chamber 41 also has a door 48 which can be opened manually.

In this embodiment, the roving chips collected in the chip collecting box 17 of the bobbin replacing apparatus 12 are sucked away into the chip collecting chamber 41 in the same manner as in Example 5, and an operator occasionally recovers the roving chips accumulated in the chamber 41 manually. Since the chip collecting chamber 41 of the transporter 13 can be allowed to have a larger capacity over the chip collecting box 17 of the bobbin replacing apparatus 12, the roving chips accumulated in the chamber 41 may be recovered far less frequently than has conventionally been needed. Further, the recovery of roving chips can also be carried out during the operation of the bobbin replacing apparatus 12.

Example 7

Figure 17:
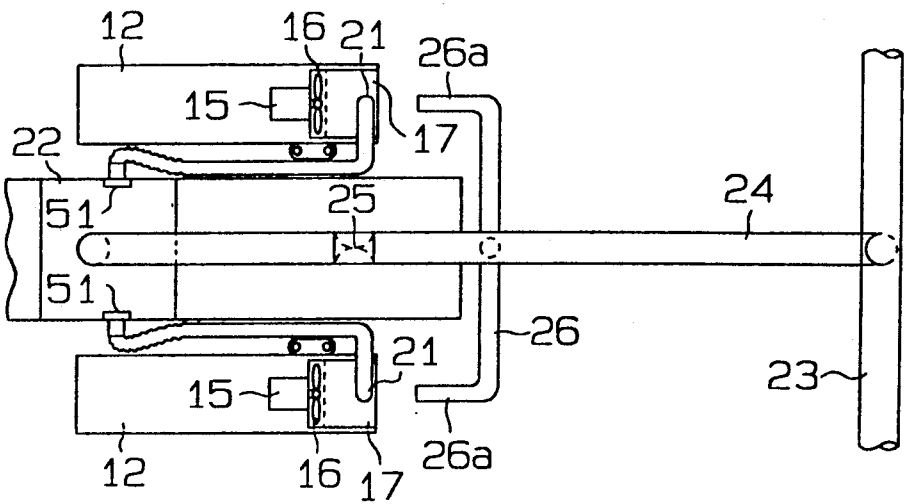
FIG. 17 shows a schematic plan view of a seventh embodiment of this invention.

Next, a seventh embodiment of this invention will be described referring to FIG. 17. What is specific to this embodiment compared with the first embodiment is that the exhaust pipe 21 of the bobbin replacing apparatus 12 is connected to the pneumatic box 22 of the spinning frame 1 so as to recover the roving chips from the chip collecting box 17. Namely, the bobbin replacing apparatus 12 has an exhaust pipe 21 having an outlet at a position to oppose the pneumatic box 22 of the spinning frame 1 so as to be retractable relative to the spinning frame 1. The side walls of the pneumatic box 22 have closable connecting holes 51 to which the outlets of the corresponding exhaust pipes 21 can be inserted. In this embodiment, the pneumatic box 22 serves as the chip removing system.

In this embodiment, the exhaust pipe 21 is connected to the connecting hole 51 of the pneumatic box 22 when the bobbin replacing apparatus 12 stops at the end side 103 of the spinning frame 1, whereby the roving chips in the chip collecting box 17 are sucked away into the pneumatic box 22. The roving chips accumulated in the pneumatic box 22 are then sucked away through the duct 24.

Example 8

Figure 18:
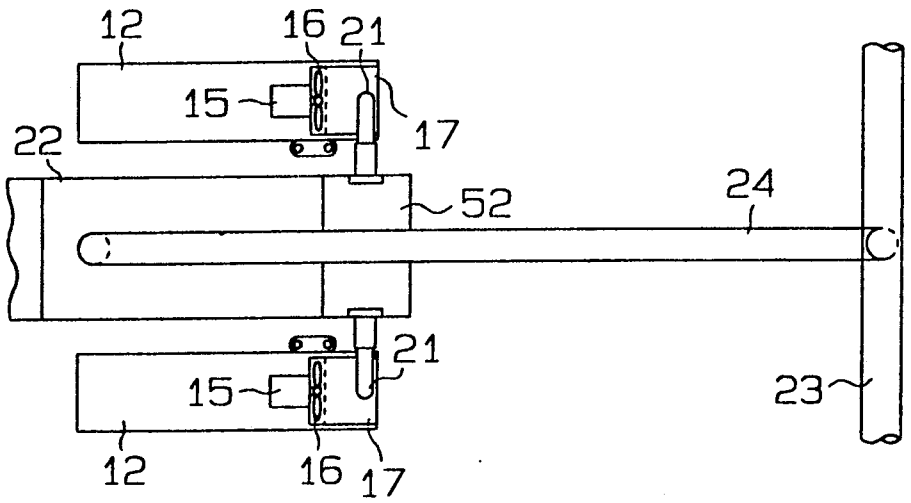
FIG. 18 shows a schematic plan view of an eighth embodiment of this invention.

An eighth embodiment of this invention will be described below referring to FIG. 18. In this embodiment, a chip collecting box 52 is disposed in the spinning frame as a chip collecting chamber on the out end side, and the exhaust pipe 21 of the bobbin replacing apparatus 12 is designed to be connected to the box 51 to recover the roving chips accumulated in the chip collecting box 17.

In this embodiment, the exhaust pipe 21 is connected to the chip collecting box 52 when the bobbin replacing apparatus 12 stops at the out end side of the spinning frame 1, whereupon the suction fan 16 in the chip collecting box 17 is driven reverse to urge the roving chips in the chip collecting box 17 into the chip collecting box 52. Namely, the chip collecting box 52 constitutes a part of the chip removing system in this embodiment. The transferring means constituting a part of the chip removing system comprises a reversely driven suction fan and the exhaust pipe 21 also serving as a communicating means.

The roving chips accumulated in the chip collecting box 51 may be recovered occasionally by an operator or by the central collecting system. Alternatively, in this embodiment, a suction device may be disposed in the chip collecting box 52 to suck away and recover the roving chips in the chip collecting box 17.

Example 9

Figure 19:
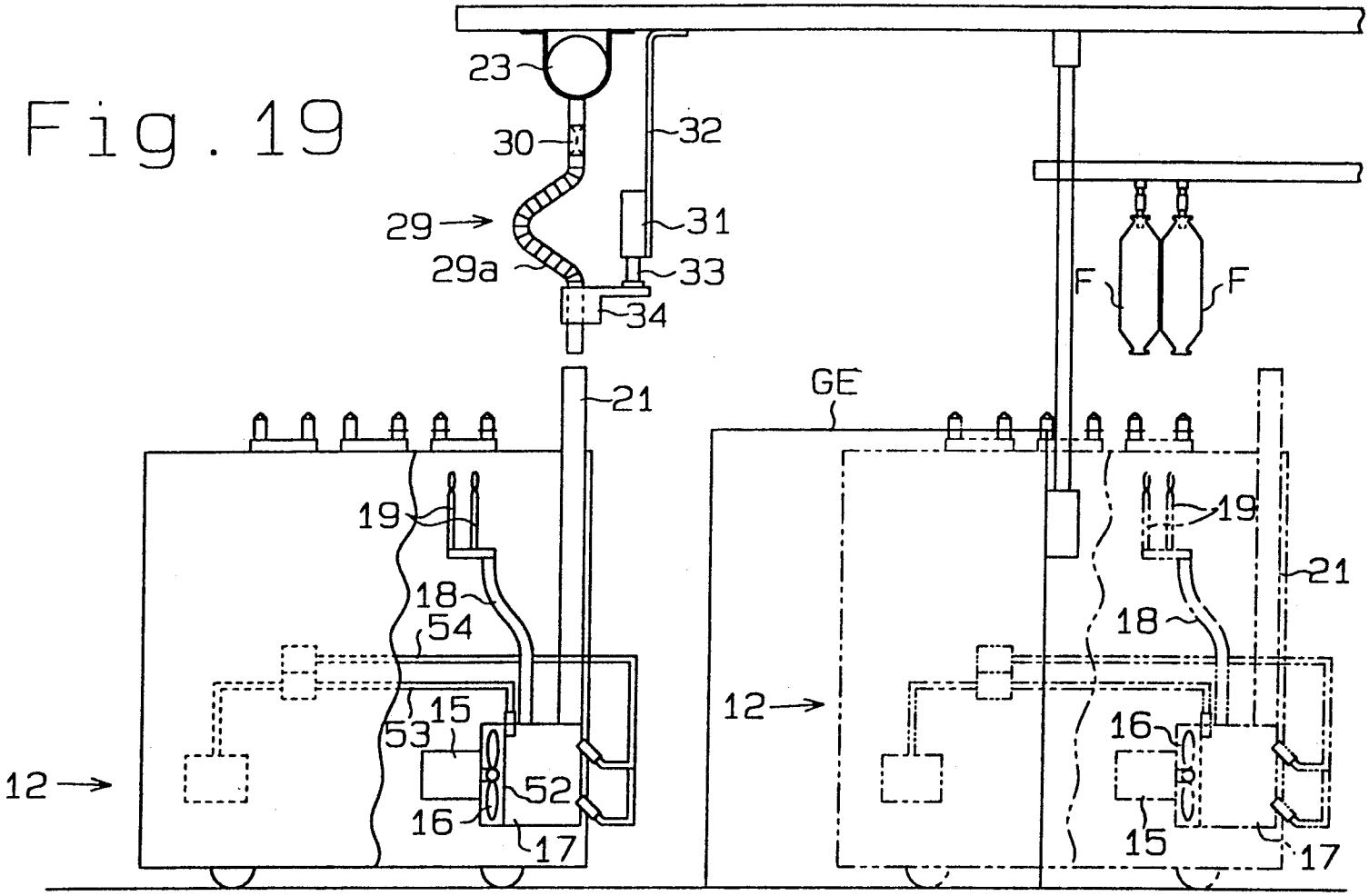
FIG. 19 shows a schematic side view of a ninth embodiment of this invention.

A ninth embodiment of this invention will be described referring to FIG. 19. A constitution similar to the second embodiment is employed in this embodiment except that a first air blow pipe 53 and a second air blow pipe 54 are disposed on the chip collecting box 17 of the bobbin replacing apparatus 12. The first air blow pipe 53 is for sweeping away the chips and fleece deposited on a screening net 52. The second air blow pipe 54 assists the central collecting duct 23 to recover the chips and fleece accumulated in the chip collecting box 17.

If the chips and fleece are heavily deposited on the screening net 52 or if the roving chips in the chip collecting box 17 are not sufficiently removed, the sucking static pressure of the suction pipe 18 will be lowered. Thus, the roving chips sucked through the suction nozzle 19 will not be opened and remain in the form of chips and carried to the central collecting duct 23 through the chip collecting box 17 Accordingly, it happens that the roving chips are caught at the joint of the central collecting duct 23 or involved by a fan (not shown) disposed in the central collecting duct 23. On the other hand, if a high level of sucking static pressure is exerted through the suction pipe 18, a high power is applied to the roving chips when they are sucked by the suction nozzle 19 to open the roving chips, and thus the above problem can be obviated.

Therefore, whenever the bobbin replacing operation is carried out, an air stream is blown from the first air blow pipe 53 onto the screening net 52. Further, whenever the fleece accumulated in the chip collecting box 17 is recovered through the central collecting duct 23, an air stream is blown from the second air blow pipe 64 toward the outlet of the chip collecting box 17 to assist recovery of the roving chips accumulated therein. Thus, the screening net 52 can constantly be maintained clean and the sucking static pressure of the suction pipe 18 can be maintained at a high level.

It should be noted that this invention is not limited to the above Examples, and it is also possible, for example in the fifth embodiment, to use an extensible connecting suction pipe 43 or exhaust pipe 44, or to use a driving means other than the air cylinder as a means for moving the suction removal pipe 29 and the like, or to dispose the central collecting duct 23 at a place other than the ceiling.

Alternatively, the chip collecting box 17 may have a closable outlet as a communicating means instead of the exhaust pipe 21, while the suction removal pipes 26 or 29 constituting the chip removing system may be elongated.

Further, it is possible to employ a construction using a photoelectric sensor for detecting the amount of the roving chips in the chip collecting box 17. The sensor outputs a command signal that the roving chips should be removed when the amount thereof is more than a predetermined set value and a command signal indicating completion of chip removal when the chip collecting box 17 is empty, respectively.

What is claimed is:

1. A roving chip collecting system for a bobbin replacing apparatus that replaces bobbins under delivery that are suspended from bobbin hangers on a plurality of creels forming part of a plurality of spinning frames with full bobbins suspended from stand-by bobbin rails extended along the side edges of the creel as the bobbin replacing apparatus moves longitudinally from a first end of the spinning frame to a second end thereof, wherein a pick finding operation of picking up the tail ends of rovings from the full bobbins is carried out using a suction pipe in a bobbin replacing operation, said spinning frames being arranged substantially in parallel, said chip collecting system comprising:

a transporter carrying the bobbin replacing apparatus along each end portion of said spinning frames;

a first chip collecting chamber disposed in said bobbin replacing apparatus for temporarily holding the unnecessary roving chips and fleece generated during pick finding under the action of said suction pipe;

a communicating means associated with said first chip collecting chamber for communicating said first chip collecting chamber to the exterior of said bobbin replacing apparatus;

a second chip collecting chamber disposed in said transporter; and a chip transferring means for transferring the chips from said first chip collecting chamber to said second chip collecting chamber through said communicating means.

2. A chip collecting system according to claim 1, wherein said communicating means includes an exhaust pipe.

3. A chip collecting system according to claim 2, wherein said exhaust pipe is extendable and may be extended and retracted by a cylinder.

4. The chip collecting system according to claim 1, wherein said communicating means includes an exhaust pipe; and wherein said chip transferring means includes:

a connecting suction pipe for connecting said first chip collecting chamber to said second chip collecting chamber; and a suction fan for generating a suction force in the connecting suction pipe of said second chip collecting chamber.

5. A chip collecting system for a bobbin replacing apparatus that replaces bobbins under delivery that are suspended from bobbin hanger rails extended along a creel of a spinning frame with full bobbins suspended from stand-by bobbin rails extended along the side edges of the creel as the bobbin replacing apparatus moves longitudinally from a first end of the spinning frame to a second end thereof, wherein a pick finding operation of picking up the tail ends of rovings from the full bobbins is carried out using a suction pipe in a bobbin replacing operation, and wherein said bobbin replacing apparatus is carried on a transporter between a plurality of spinning frames arranged in a row, the chip collecting system comprising:

a first chip collecting chamber disposed in said bobbin replacing apparatus for temporarily holding chips and fleece generated during pick finding under the action of said suction pipe;

a first communicating means associated with said first chip collecting chamber for communicating said first chip collection chamber to the exterior of said bobbin replacing apparatus;

a second chip collecting chamber disposed in said transporter;

a connecting suction means disposed on said transporter and in fluid flow connection with said second chip collecting chamber that is selectively connectable with said first communicating means;

a second communicating means associated with said second chip collecting chamber; and a suction removable pipe disposed along a path of movement of the transporter beside the row of spinning frames and connected to a central collecting duct, the suction removal pipe being connectable to the second communicating means.

6. The chip collecting system according to claim 5, wherein said first and second communicating means are exhaust pipes.

7. The chip collecting system according to claim 6, wherein said exhaust pipes are extendable and may be extended and retracted by a cylinder.

8. The chip collecting system according to claim 5, wherein said connecting suction means includes a connecting suction pipe and a suction fan disposed in the transporter.

9. The chip collecting system according to claim 5, wherein said suction removal pipe is extendable and may be extended and retracted by a cylinder.

* * * * *